US006243027B1

(12) United States Patent
Hill

(10) Patent No.: US 6,243,027 B1
(45) Date of Patent: Jun. 5, 2001

(54) SYSTEM CORRELATING THE ROUTE OF TRAVEL OF AN EMERGENCY VEHICLE WITH A RAILROAD CROSSING

(76) Inventor: James L. Hill, 9071 E. Rockwood Dr., Scottsdale, AZ (US) 85255

( * ) Notice: Subject to any disclaimer, the term of this patent is extended or adjusted under 35 U.S.C. 154(b) by 0 days.

(21) Appl. No.: 09/551,059

(22) Filed: Apr. 18, 2000

(51) Int. Cl.[7] ..... G08G 1/095

(52) U.S. Cl. ..... 340/907; 340/905; 340/910; 340/938; 340/539

(58) Field of Search ..... 340/907, 910, 340/915, 933, 938, 988, 989, 993, 902, 905, 906, 433, 539; 701/117, 118, 202, 205

(56) References Cited

U.S. PATENT DOCUMENTS 5,014,052 * 5/1991 Obeck ..... 340/906
5,289,183 * 2/1994 Hassett et al. ..... 340/905
5,539,398 * 7/1996 Hall et al. ..... 340/907
5,572,201 * 11/1996 Graham et al. ..... 340/902
5,713,540 * 2/1998 Gerszberg et al. ..... 246/121
5,735,492 * 4/1998 Pace ..... 246/125
5,767,788 * 6/1998 Ness ..... 340/825.49
5,864,304 * 1/1999 Gerszberg et al. ..... 340/903
5,954,299 * 9/1999 Pace ..... 246/293
6,020,815 * 2/2000 Eslambolchi et al. ..... 340/539

* cited by examiner

*Primary Examiner*—Daniel J. Wu
*Assistant Examiner*—Toan Pham
(74) *Attorney, Agent, or Firm*—Tod R. Nissle, P.C.

(57) ABSTRACT

A system for correlating the route of travel of an emergency vehicle with a railroad crossing by, when the crossing is blocked, sensing the presence of a train and communicating between the railroad crossing, police stations, fire stations, and an emergency vehicle dispatch center.

2 Claims, 1 Drawing Sheet

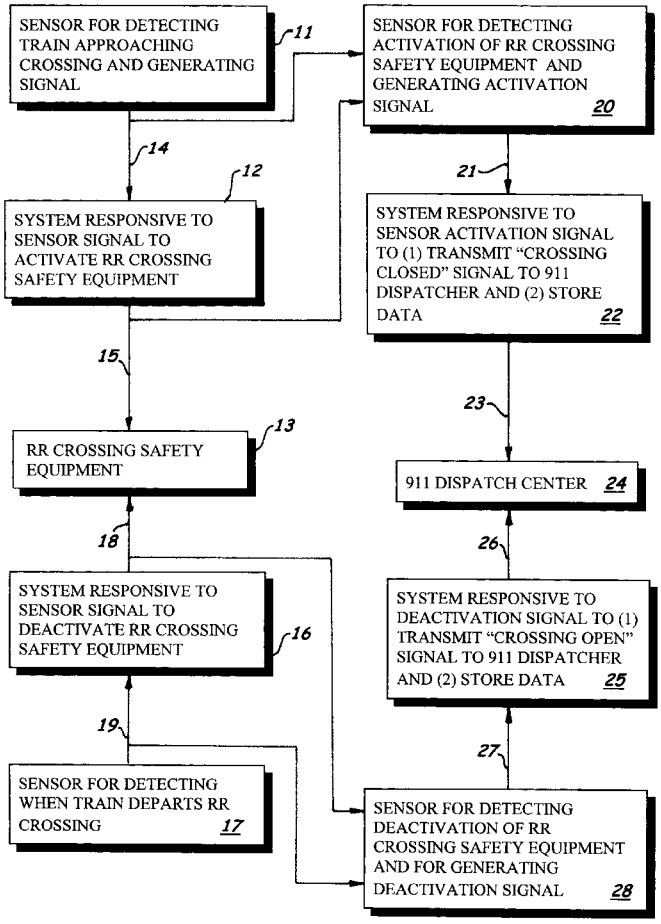

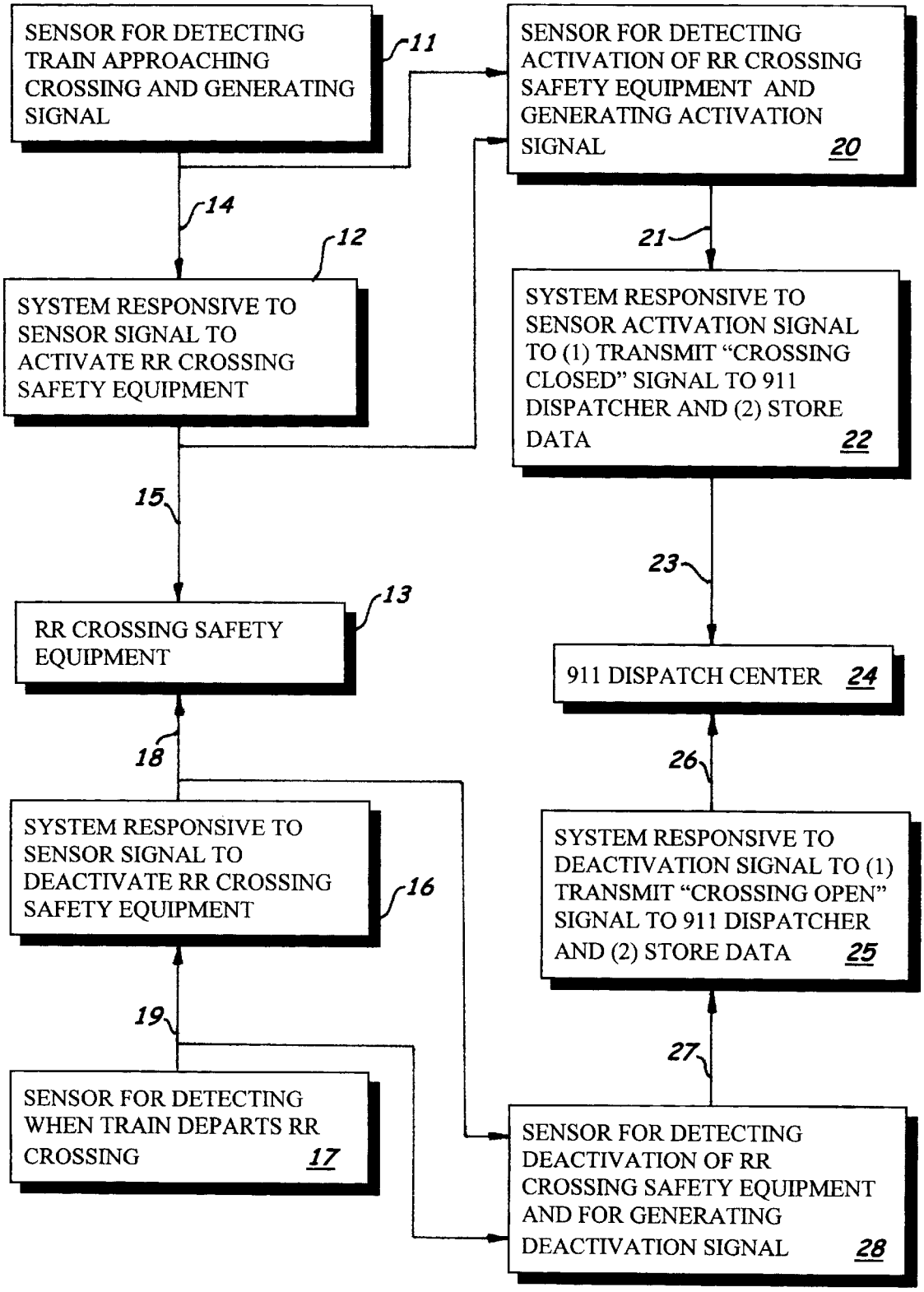
SENSOR FOR DETECTING TRAIN APPROACHING CROSSING AND GENERATING SIGNAL
11
SENSOR FOR DETECTING ACTIVATION OF RR CROSSING SAFETY EQUIPMENT AND GENERATING ACTIVATION SIGNAL 20
14
12
21
SYSTEM RESPONSIVE TO SENSOR SIGNAL TO ACTIVATE RR CROSSING SAFETY EQUIPMENT
SYSTEM RESPONSIVE TO SENSOR ACTIVATION SIGNAL TO (1) TRANSMIT "CROSSING CLOSED" SIGNAL TO 911 DISPATCHER AND (2) STORE DATA 22
15
23
13
RR CROSSING SAFETY EQUIPMENT
911 DISPATCH CENTER 24
18
26
SYSTEM RESPONSIVE TO SENSOR SIGNAL TO DEACTIVATE RR CROSSING SAFETY EQUIPMENT
16
SYSTEM RESPONSIVE TO DEACTIVATION SIGNAL TO (1) TRANSMIT "CROSSING OPEN" SIGNAL TO 911 DISPATCHER AND (2) STORE DATA 25
19
27
SENSOR FOR DETECTING WHEN TRAIN DEPARTS RR CROSSING 17
SENSOR FOR DETECTING DEACTIVATION OF RR CROSSING SAFETY EQUIPMENT AND FOR GENERATING DEACTIVATION SIGNAL 28

SYSTEM CORRELATING THE ROUTE OF TRAVEL OF AN EMERGENCY VEHICLE WITH A RAILROAD CROSSING

FIELD OF THE INVENTION

Background of the Invention

This invention pertains to systems for dispatching emergency vehicles.

More particularly, the invention relates to a system for correlating the route of travel of an emergency vehicle with one or more selected railway crossings.

The use of the telephone number "911" and of other telephone numbers to summon an ambulance, a fire engine, police car or another emergency vehicle is well known. Dispatchers who receive 911 and similar emergency calls direct, when necessary, emergency vehicles to selected locations and street addresses.

One problem which has long been encountered is that a dispatcher does not know, when a vehicle is dispatched, if a railway crossing on the route to be traveled by the vehicle is blocked. The dispatcher becomes aware of the blocked railway crossing only when the dispatched vehicle encounters the blocked crossing and radios the dispatcher. The dispatcher can then, upon being notified that the railway crossing is blocked, dispatch a second emergency vehicle along a route of travel which will not encounter the blocked railway crossing. While dispatching a second emergency vehicle appears, at first blush, to be a simple solution to the problem, this solution often proves deadly. An individual suffering a heart attack has about an 80% chance of survival if an emergency vehicle arrives two minutes after the attack. If the emergency vehicle arrives four minutes after the attack, the individual has about a 50% chance of survival. If the emergency vehicle arrives six minutes after the heart attack, the individual has less than a 10% chance of survival. Consequently, when a dispatcher has to send out a second emergency vehicle because the first encounters a blocked railway crossing, the likelihood that a person who has had a heart attack will survive is significantly reduced. Similarly, when a fire engine is dispatched and is delayed at a blocked railway crossing, requiring the dispatching of a second fire engine, the likelihood that a structure will be completely consumed by fire ordinarily is significantly increased. There are also cases where the timeliness of police intervention determines whether a crime or serious injury occur.

SUMMARY OF THE INVENTION

Accordingly, it would be highly desirable to provide an improved emergency vehicle dispatch system which would avoid delays encountered when a railway crossing is blocked by a train.

Therefore, it is a principal object of the instant invention to provide an improved emergency vehicle dispatch system.

Another object of the invention is to provide an improved emergency vehicle dispatch system which will insure that an emergency vehicle will not encounter a blocked railway crossing along the route taken by the emergency vehicle in traveling to its destination.

These and other, further and more specific objects and advantages of the invention will be apparent to those skilled in the art from the following detailed description thereof, taken in conjunction with the drawing which sets forth an emergency dispatch system constructed in accordance with the principles of the invention.

Briefly, in accordance with the invention, I provide an improved system for dispatching an emergency vehicle. The system includes a dispatch center for receiving emergency calls requesting an emergency vehicle and including a receiver; and, a monitoring system at a railway crossing remote from the dispatch center. The monitoring system includes a sensor for determining when a train is blocking the railway crossing, and a transmitter for transmitting to the receiver a signal when the railway crossing is blocked.

In another embodiment of the invention, I provide an improved method for dispatching an emergency vehicle. The improved method includes the steps of providing a dispatch center for receiving emergency calls requesting an emergency vehicle and including a receiver; providing a monitoring system at a railway crossing remote from said dispatch center; and, providing a notification system attached to the receiver. The monitoring system includes a sensor for determining when a train is blocking the railway crossing, and a transmitter for transmitting to the receiver a signal when the railway crossing is blocked. When the receiver receives the signal, the notification system notifies the dispatch center that the railway crossing is blocked. When the dispatch center receives a call requesting the dispatch of an emergency vehicle and the notification system indicates that the railway crossing is blocked, the dispatch center dispatches the emergency vehicle along a route of travel which avoids the blocked railway crossing.

BRIEF DESCRIPTION OF THE DRAWING

FIG. 1 is a block schematic diagram of a system correlating the route of travel of an emergency vehicle with a railroad crossing.

DETAILED DESCRIPTION OF THE EMBODIMENT OF THE INVENTION

Turning now to the drawing, which depicts the presently preferred embodiments of the invention for the purpose of illustrating the practice thereof and not by way of limitation of the scope of the invention, the emergency dispatch system includes a dispatch center 24. While the configuration and equipment at the dispatch center can vary as desired, the function of the dispatch center is to receive a communication from an individual requesting an ambulance, fire truck, police car, or other emergency vehicle. The dispatch center can receive a communication by telephone, by microwave, by word of mouth, or by any other form of message transmission. The dispatch center is contacted by dialing 911, by dialing any other desired telephone number, or by taking any other desired action. When the dispatch center receives a request for an emergency vehicle, the dispatch center also receives the location or address to which an emergency vehicle(s) is to be directed. The dispatch center also has telephones, wireless, or any other transmission means for contacting and dispatching an emergency vehicle. In addition, the dispatch center can include a map, either on paper or computer, or can include the personal knowledge of a dispatcher to facilitate determining desirable routes along which the emergency vehicle can travel to a desired address. Or, the emergency vehicle or the driver of the vehicle may have a map or personal knowledge of the area and be able to determine an appropriate route to the destination of the emergency vehicle.

Each railroad crossing remote from the dispatch center 24 normally includes railroad crossing safety equipment, especially when the railroad crossing is in a town or metropolitan area. Such safety equipment typically includes gates which lower when a train is approaching and traveling through the crossing and includes flashing lights mounted on the gates or on a stationary railroad crossing sign which is positioned off the road and to the right of cars approaching the crossing. The safety equipment can include bells, horns or any other desired means of notifying a vehicle driver that there is an approaching train. The safety equipment at a railroad crossing can also include traffic lights.

Each railroad crossing which is provided with safety equipment also usually includes a sensor 11 for detecting when a train is approaching. This sensor can, by way of example and not limitation, comprise an electrical or optical sensor or a sensor activated by vibrations in rails comprising the train tracks. The sensor is positioned so that an oncoming train is sensed when it is a selected distance from the crossing.

Similarly, each railroad crossing usually includes a sensor 17 for detecting when a train has left the crossing, is moving away from the crossing, and is a selected distance away from the crossing. If desired, a sensor 11 can perform both the function of sensing an approaching train and of sensing a departing train.

When sensor 11 detects an approaching train, a signal 14 is generated. When this signal is received by the activation system 12 at the railroad crossing, the activation system 12 generates a signal(s) 15 which activates the safety equipment at the crossing. The gate is activated so the gate lowers from its normal upright position to a generally horizontal position which extends across the road and prevents vehicles from entering the railroad crossing. The lights on the stationary railroad crossing sign are activated such that the lights flash on and off. Ordinarily, at a minimum, at least the lights on the railroad crossing sign are activated even if other safety equipment like gates are not activated at the railroad crossing. Safety equipment at a railroad crossing is presently normally activated when electrical contacts close.

When sensor 17 detects that a train is moving away from and has departed the railway crossing, a signal 19 is generated. When this signal is received by the activation system 16 at the railroad crossing, the activation system 16 generates a signal(s) 18 which deactivates the safety equipment at the crossing. The gate is deactivated so the gate raises from its generally horizontal position back to it normal upright operative position. The lights on the stationary railroad crossing sign are deactivated such that the lights are turned off and no longer flash on and off. The traffic lights are allowed to resume their normal cycling from green to yellow to red. The safety equipment at the crossing is normally deactivated by opening electrical contacts.

The dispatch system of the invention also includes a sensor 20 for detecting when the railroad crossing safety equipment is activated or is being deactivated. Sensor 20 presently preferably determines when safety equipment is being activated (electrical contacts close) or deactivated (electrical contacts open) by monitoring electrical contacts at or near the crossing. Sensor 20 generates an activation signal 21 after sensor 20 detects that the railroad crossing safety equipment is activated or is being activated. Sensor 20 ordinarily is located at the railroad crossing, although it is possible that sensor 20 could be located remote from the railroad crossing in a satellite or in some other structure which can sense movement, vibration, or some other physical property over a long distance. Signal 21 is received by a traffic signal controller. The traffic signal controller begins a preemption sequence which causes traffic lights at or near the railroad crossing to turn and stay red until a train has passed through the crossing. The traffic signal controller is normally located at or near the intersection at which the traffic lights are located, but can be located at any desired location.

Signal 21 is received by system 22 which transmits a signal 23 to dispatch center 24 and, if desired, to one or more fire stations, police stations, ambulance stations, or other centers which dispatch emergency equipment. Signal 23 informs center 24 and each fire station, police station, etc. that the railroad crossing is closed and preferably includes the location of the crossing, the date, the time the train arrived at the crossing, the elapsed time since the train arrived at the crossing and is continuing to pass through the crossing, and the time of day. This information (i.e., the location of the crossing, the date, the time the train arrived, etc.) is displayed on a screen, on paper, etc. at center 24 and at each fire station, police station, etc. The location of the crossing, the date, the time the train arrived at the crossing, the elapsed time since the train arrived at the crossing and is continuing to pass through the crossing, and the time of day can be stored in computer memory, on paper tape print out, etc. by system 22 at the railroad crossing. Similarly, this information can be stored in computer memory, on paper tape print out, etc. at and by dispatch center 24 and each fire station, police station, etc. On receipt of signal 23, a notification system alerts a dispatcher at center 24 that a railway crossing is closed. A horn or other audible alarm then sounds, or can sound at any desired time or times after a train reaches the crossing. A flashing light can be activated at center 24. The location of the railroad crossing is preferably displayed on the CRT screen of a computer. For sake of example, and not by way of limitation, it is assumed that the railroad crossing is located at or near the intersection of $5^{th}$ Street and Wilmont Street in a town or city. The following location would, along with the date, the time that a train entered the crossing, the elapsed time since the train entered the crossing, and any other desired information, then appear on the screen of a computer monitored by a dispatcher at center 24:

$5^{th}$ Street and Wilmont

When "$5^{th}$ Street and Wilmont" appeared on the screen, the dispatcher would know that this crossing is blocked and that an emergency vehicle should not be dispatched along a route which would take the vehicle through the crossing. Instead, the emergency vehicle is dispatched along a route which avoids the crossing.

The dispatch system of the invention also includes a sensor 28 for detecting when the railroad crossing safety equipment is deactivated or is being deactivated. Sensor 28 generates an deactivation signal 27 after sensor 28 detects that the railroad crossing safety equipment is deactivated or is being deactivated. Sensor 28 ordinarily is located at the railroad crossing, although it is possible that sensor 28 could be located remote from the railroad crossing in a satellite or in some other structure which can sense movement, vibration, or some other physical property over a long distance.

Signal 27 is received by system 25 which transmits a signal 26 to dispatch center 24 and to each fire station, police station, etc. Signal 26 informs center 24 that the railroad crossing is open and preferably includes the location of the crossing, the date, the elapsed time necessary for the train to pass through the crossing, and the time of day. A flashing light, audible alarm, or other means is activated at center 24 to alert the dispatcher(s) at center 24. The location of the crossing, the date, the elapsed time necessary for the train to pass through the crossing, and the time of day can be stored in computer memory, on paper tape print out, etc. by system 25 at the railroad crossing. Similarly, this information can be stored in computer memory, on paper tape print out, etc. at and by dispatch center 24. On receipt of signal 26, the location of the railroad crossing is removed from the CRT screen of a computer. Consequently, the listing:

$5^{th}$ Street and Wilmont Street

Is removed form the computer screen being monitored by a dispatcher at center 24. When "$5^{th}$ Street and Wilmont" is removed from the screen, the dispatcher knows that this crossing is open and that an emergency vehicle can be dispatched along a route which takes the vehicle through the crossing.

Instead of displaying on a computer screen the "$5^{th}$ Street and Wilmont Street" address of a railroad crossing which is blocked by a train, a large map can be equipped with lights at each crossing such that the light at an intersection is illuminated or blinks when a train is blocking the crossing. Any other means can be utilized to indicate to an operator at center 24 the location of a blocked crossing.

Signal 26 or 27 is also received by the traffic signal controller. The traffic signal controller cancels the preemption sequence so that the traffic lights return to their normal sequence of operation in which for a short period of time traffic moving on a first street receives a green light while traffic moving on a second street which intersects and is at an angle with respect to the first street receives a red light, after which for a short period of time traffic on the first street receives a red light and traffic on the second street receives a green light, after which for a short period of time traffic on the first street receives a green light and traffic on the second street receives a red light, etc.

In order to determine that safety equipment 13 is being activated at a railroad crossing, sensor 20 can monitor sensor 11, system 12, and/or equipment 13 and can, for example, generate signal 21 (1) when sensor 11 detects an approaching train and generates signal 14, (2) when system 12 generates signal 15, or (3) when equipment 13 is activated. By way of example, and not limitation, sensor 20 can determine when equipment 13 is activated by monitoring a switch which is closed to deliver electricity to safety equipment 13.

In order to determine that safety equipment 13 is being deactivated at a railroad crossing, sensor 28 can monitor sensor 17, system 16, and/or equipment 13 and can, for example, generate signal 21 (1) when sensor 17 detects a departing train and generates signal 19, (2) when system 16 generates signal 18, or (3) when equipment 13 is deactivated. By way of example, and not limitation, sensor 28 can determine when equipment 13 is deactivated by monitoring a switch which is opened to halt the flow of electricity to equipment 13.

In practice, sensors 11 and 17, systems 12 and 16, and one or more pieces of safety equipment 13 exist at many railroad crossings. Sensors 20 and 28 and systems 22 and 25 are installed at each of these crossings so that center 24 receives a signal 23 when a train approaches any of the railroad crossings so equipped. Similarly, center 24 receives a signal 27 when a train departs any of the railroad crossings so equipped.

In operation, a dispatcher at center 24 sits in front of a computer awaiting calls requesting the dispatching of an emergency vehicle. A train approaches the railroad crossing at $5^{th}$ Street and Wilmont Street. Sensor 11 detects the train and generates signal 14. System 12 receives signal 14 and generates signal 15 activating equipment 13. Equipment 13 includes a gate which lowers when the gate is activated. Equipment 13 also includes warning lights which begins to flash when activated. The warning lights are each visible to the drivers in vehicles which approach the railroad crossing from at least one direction, i.e., it is possible that the flashing warning light can be visible to drivers approaching the railroad crossing from any direction. Sensor 20 detects when sensor 11 generates signal 14. Sensor 20 then generates signal 21. Signal 21 is received by activation system 22. System 22 stores in its memory, the time of day, date, location ($5^{th}$ Street and Wilmont Street) and any other desired information concerning the railroad crossing. System 22 generates signal 23 and transmits signal 23 to center 24, as well as to selected fire stations, police stations, etc. Signal 21 or 23 or another signal is transmitted to a traffic signal controller (if appropriate) to initiate the preemption sequence for any traffic lights at or near the railroad crossing.

Signal 23 informs center 24 and fire stations, police stations, etc. that the railway crossing at $5^{th}$ Street and Wilmont Street is closed. An audible alarm and flashing light are activated at center 24 and at each fire station, police station, etc. The crossing location, the date, the time the train arrives at the crossing, the elapsed time since the train arrived at the crossing and is continuing to pass through the crossing, and the time of day are displayed at center 24 and at each fire station, police station, etc. Signal 23 also transmits the time of day and date to center 24 (This information can, if desired, be obtained from computers or other sources at center 24). The following appears on the dispatcher's screen:

$5^{th}$ Street and Wilmont Street

The dispatcher sees "$5^{th}$ Street and Wilmont Street" on his screen and knows that the railroad crossing at that location is closed or blocked. The dispatcher receives a first telephone call for an emergency vehicle. The dispatcher notices that the route which the first emergency vehicle ordinarily would take to get to the designated destination does not go through the railway crossing at $5^{th}$ Street and Wilmont Street. Consequently, the dispatcher sends the first emergency vehicle to the designated destination via the normal route. The dispatcher then receives a second telephone call for an emergency vehicle. The dispatcher notices that the route which the second emergency vehicle ordinarily would take to get to the designated destination goes through the railway crossing at $5^{th}$ Street and Wilmont Street. Accordingly, the dispatcher dispatches the second emergency vehicle to its intended destination over a secondary travel route which does not go through the railway crossing at $5^{th}$ Street and Wilmont. Sensor 17 detects that the train has departed the crossing at $5^{th}$ Street and Wilmont. Sensor 17 generates signal 19. System 16 receives signal 19 and generates signal 18 to deactivate the safety equipment at the crossing. The crossing gate raises and the warning lights stop flashing. Sensor 28 detects when sensor 17 generates signal 19. When sensor 28 detects sensor 17 generating signal 19, sensor 28 generates signal 27. Signal 19 and/or 27 (or another desired signal) is received by the traffic signal controller. The traffic signal controller brings an end to the traffic signal preemption and permits the traffic lights to return to their normal red, yellow, green cycling.

Deactivation system 25 receives signal 26. Deactivation system 25 then generates signal 26 and stores in system 25's memory the date, time of day, total elapsed time that the crossing was closed (i.e., the time from when equipment 13 was activated by signal 15 until equipment 13 was deactivated by signal 18), the location ($5^{th}$ Street and Wilmont Street) of the railway crossing, and any other desired information concerning the crossing. Center 24 receives signal 26. Signal 26 informs center 24 that the crossing at $5^{th}$ Street and Wilmont Street is open. An audible alarm and flashing light are activated at the dispatch center 24. The signal 26 also sends the date, time of day, location of the crossing, and the total elapsed time the crossing was closed. The following disappears from the dispatcher's CRT screen:

$5^{th}$ Street and Wilmont Street

The dispatcher receives a call for a third emergency vehicle. The dispatcher notes that in order to reach its assigned destination, the third emergency vehicle ordinarily will travel a route which will take it through the railway crossing at $5^{th}$ Street and Wilmont Street. Since, however, the dispatcher knows that this railway crossing is now open, the dispatcher sends the third emergency vehicle along its ordinary route and permits the third emergency vehicle to pass through the railway crossing at $5^{th}$ Street and Wilmont Street.

The date, time of day, length of time a crossing is closed during each close-open occurrence, location of the crossing, and any other desired information can be printed out or downloaded from system 22, system 25, and/or the computer or other memory storage unit at center 24. Such downloading ordinarily can be done as frequently or infrequently as desired.

The system of the invention can also, as would be appreciated by those of skill in the art, be utilized on draw bridges.

Signals 23 and 26 are presently preferably transmitted by utilizing in systems 22 and 25 radio transceivers which operate at 902 to 928 MHz, have a transmitted power of one watt, and have a range of sixty miles. As noted earlier, the means used to transmit signals 23 and 26 can be hard wired, can utilize microwaves, etc. and can vary as desired. A transceiver identical to the one used in conjunction with systems 22 and 25 is presently utilized at center 24 to communicate with the transceiver utilized at a railway crossing with systems 22 and 25.

Systems 22 and 25 (or 12 and 16) can be combined into a single unit which performs each of the functions required by systems 22 and 25. Sensors 20 and 28 (or 11 and 17) can be combined into a single unit which performs each of the functions required by sensors 20 and 28.

Sensor 20, 28 or another sensor can also send a signal to center 24 and/or each fire station, police station, etc. indicating when there is a power failure.

Having described my invention in such terms as to enable those of skill in the art to make and practice it, and having described the presently preferred embodiments thereof, I claim:

1. A system for dispatching an emergency vehicle including (a) a dispatch center for receiving emergency calls requesting an emergency vehicle and including a receiver; and, (b) monitoring means at a railway crossing remote from said dispatch center and including (i) sensor means for determining when a train is blocking the railway crossing, and (ii) a transmitter for transmitting to said receiver a signal when the railway crossing is blocked.

2. A method for dispatching an emergency vehicle including the steps of (a) providing (i) a dispatch center for receiving emergency calls requesting an emergency vehicle and including a receiver, and (ii) monitoring means at a railway crossing remote from said dispatch center and including sensor means for determining when a train is blocking the railway crossing, and a transmitter for transmitting to said receiver a signal when the railway crossing is blocked a transmitter for transmitting to said receiver a signal when the railway crossing is blocked, and (iii) notification means attached to said receiver to notify, when said receiver receives said signal, the dispatch center that the railway crossing is blocked; and, (b) when the dispatch center receives a call requesting the dispatch of an emergency vehicle and said notification means indicates that the railway crossing is blocked, dispatching the emergency vehicle along a route of travel which avoids the blocked railway crossing.

* * * * *